US008757608B2

(12) United States Patent
Fukatsu et al.

(10) Patent No.: US 8,757,608 B2
(45) Date of Patent: Jun. 24, 2014

(54) SHEET PROCESSING APPARATUS THAT CARRIES OUT POST-PROCESSING ON FOLD OF SHEET BUNDLE

(75) Inventors: Yasuo Fukatsu, Abiko (JP); Hitoshi Kato, Toride (JP); Naoki Ishikawa, Kashiwa (JP); Tomoharu Sato, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/448,507

(22) Filed: Apr. 17, 2012

(65) Prior Publication Data

US 2012/0261873 A1 Oct. 18, 2012

(30) Foreign Application Priority Data

Apr. 18, 2011 (JP) ..... 2011-092015

(51) Int. Cl.
*B65H 31/26* (2006.01)
*B65H 31/30* (2006.01)

(52) U.S. Cl.
USPC ..... 270/45; 270/58.07

(58) Field of Classification Search
USPC ..... 270/45, 58.07; 493/406, 407, 442, 454
See application file for complete search history.

(56) References Cited

U.S. PATENT DOCUMENTS

| | | | | |
|---|---|---|---|---|
| 6,692,208 | B1 | 2/2004 | Watkiss et al. | |
| 7,328,893 | B2 * | 2/2008 | Kawatsu et al. | 270/58.09 |
| 8,186,663 | B2 * | 5/2012 | Suzuki et al. | 270/45 |
| 8,191,882 | B2 * | 6/2012 | Kikkawa et al. | 270/45 |
| 2012/0252649 | A1 * | 10/2012 | Kato et al. | 493/465 |

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which is capable of enhancing productivity in flattening a fold top of a sheet bundle. The sheet processing apparatus has a conveying unit that conveys a folded sheet bundle to a processing position, and a holding unit that holds the sheet bundle conveyed by the conveying unit. When the folded sheet bundle has been conveyed by a predetermined distance after a leading end of the sheet bundle has been detected and before the sheet bundle reaches a processing position, the holding unit starts holding the sheet bundle, and then the conveying units stops conveyance of the sheet bundle.

5 Claims, 17 Drawing Sheets

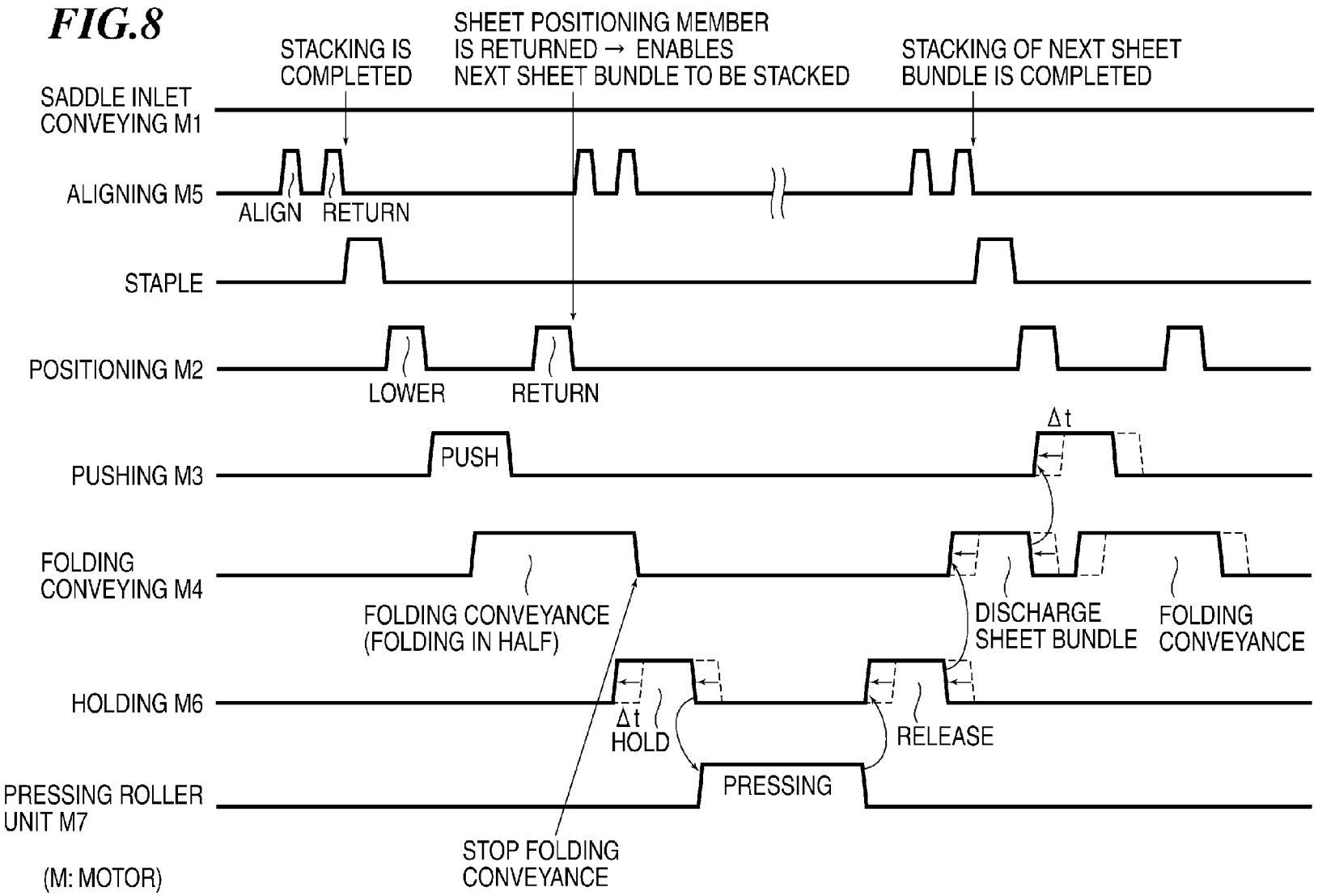
FIG.8
SADDLE INLET CONVEYING M1
ALIGNING M5
STAPLE
POSITIONING M2
PUSHING M3
FOLDING CONVEYING M4
HOLDING M6
PRESSING ROLLER UNIT M7
(M: MOTOR)
STACKING IS COMPLETED
ALIGN
RETURN
SHEET POSITIONING MEMBER IS RETURNED → ENABLES NEXT SHEET BUNDLE TO BE STACKED
STACKING OF NEXT SHEET BUNDLE IS COMPLETED
LOWER
RETURN
PUSH
Δt
FOLDING CONVEYANCE (FOLDING IN HALF)
DISCHARGE SHEET BUNDLE
FOLDING CONVEYANCE
Δt
HOLD
RELEASE
PRESSING
STOP FOLDING CONVEYANCE

*FIG.15*

| SHEET TYPE | THICKNESS OF 10 SHEETS (mm) | THICKNESS OF 20 SHEETS (mm) | THICKNESS OF 30 SHEETS (mm) | THICKNESS OF 40 SHEETS (mm) | THICKNESS OF 50 SHEETS (mm) |
|---|---|---|---|---|---|
| A | 0.932 | 1.864 | 2.796 | 3.728 | 4.66 |
| B | 1.073 | 2.146 | 3.219 | 4.292 | 5.365 |
| ... | ... | ... | ... | ... | ... |
| ... | ... | ... | ... | ... | ... |

SHEET PROCESSING APPARATUS THAT CARRIES OUT POST-PROCESSING ON FOLD OF SHEET BUNDLE

BACKGROUND OF THE INVENTION

1. Field of the Invention

The present invention relates to a sheet processing apparatus that carries out post-processing on a fold of a sheet bundle stacked and folded.

2. Description of the Related Art

Conventionally, there have been known finishers having a mechanism to collectively fold a plurality of sheets and sheet bundles stacked and folded on a stacking tray in a tile-stacking manner, as finishers that carry out various types of post-processing on sheets on which images have been formed by an image forming apparatus. In this case, roughly, when a set of sheets consisting of twenty or more sheets are collectively folded, a fold top of a finished sheet bundle is curved. Because such a sheet bundle is poorly folded, the sheet bundle opens immediately after it is folded, and it is poor-looking in appearance. Moreover, such a poorly-folded (that is, weakly-folded) sheet bundle opens on its edge side, and a front cover surface tilts. It is thus difficult to stack a number of sheet bundles on the stacking tray.

To cope with this problem, there has been proposed a method and apparatus that brings a fold top of a poorly-folded sheet bundle into pressure to thereby flatten the fold top (see U.S. Pat. No. 6,692,208). FIGS. 17A and 17B are views schematically showing an arrangement of a conventional apparatus which flattens a fold top of a poorly-folded sheet bundle, and how the apparatus operates. In this conventional apparatus, first, as shown in FIG. 17A, a fold top 706 of a sheet bundle 701 is folded between holding members 702 and 703 by a pushing plate 705. Then, as shown in FIG. 17B, the fold top 706 is brought into contact with a stop plate 704, then the pushing plate 705 is pulled out, and the sheet bundle 701 is held by the holding members 702 and 703.

However, in the case of the apparatus and method shown in FIGS. 17A and 17B, because holding by the holding members 702 and 705 is started after the pushing plate 705 brings the fold top 706 into contact with the stop plate 704, the flattening process takes a long time, and a sheet bundle to be processed next stands by for a long time. Therefore, the problem of a reduction in productivity arises.

SUMMARY OF THE INVENTION

The present invention provides a sheet processing apparatus capable of enhancing productivity in flattening a fold top of a sheet bundle.

Accordingly, a first aspect of the present invention provides a sheet processing apparatus comprising: a conveying unit configured to convey a folded sheet bundle to a processing position; a conveyance amount detecting unit configured to detect a conveyance amount by which the sheet bundle is conveyed by the conveying unit; a leading end detecting unit configured to detect a leading end of the sheet bundle conveyed by the conveying unit; a holding unit configured to hold the sheet bundle conveyed by the conveying unit in a thickness direction of the sheet bundle; and a control unit configured to, when the conveyance amount detecting unit detects that the sheet bundle has been conveyed by a predetermined distance after the leading end detecting unit has detected the leading end of the sheet bundle and before the sheet bundle reaches the processing position, cause the holding unit to start holding the sheet bundle and then cause the conveying unit to stop conveying the sheet bundle.

Accordingly, a second aspect of the present invention provides a sheet processing apparatus comprising: a conveying unit configured to convey a folded sheet bundle to a processing position; a leading end detecting unit configured to detect a leading end of the sheet bundle conveyed by the conveying unit; a holding unit, comprising a fixed first holding plate that is fixed and a second holding plate that is movable, configured to hold the sheet bundle by the second holding plate moving toward the first holding plate; a thickness calculating unit configured to obtain a thickness of the sheet bundle conveyed by the conveying unit; a movement amount calculating unit configured to calculate a movement amount by which the second holding plate reaches the sheet bundle so as to hold the sheet bundle using the thickness of the sheet bundle obtained by the thickness calculating unit; a time period calculating unit configured to calculate a time period required for the second holding plate to move by the movement amount calculated by the movement amount calculating unit; and a control unit configured to, when a time period obtained by subtracting the time period calculated by the time period calculating unit from a time period required for the sheet bundle to move by a predetermined distance has elapsed after the leading end detecting unit has detected the leading end of the sheet bundle, cause the holding unit to start holding the sheet bundle and then cause the conveying unit to stop conveying the sheet bundle.

Accordingly, a third aspect of the present invention provides a sheet processing apparatus comprising: a conveying unit configured to convey a folded sheet bundle to a processing; a holding unit, comprising a first holding member and a second holding member, configured to hold the sheet bundle conveyed by the conveying unit in a thickness direction of the sheet bundle by movement of at least one of the first holding member and the second holding member; a pressing unit configured to press a hold of the sheet bundle held by the holding unit at the processing position; and a control unit configured to cause the holding unit to start holding the sheet bundle before the sheet bundle reaches the processing position and then cause the conveying unit to stop conveying the sheet bundle.

According to the present invention, in a case where the fold top of the sheet bundle is flattened, productivity can be enhanced by optimizing the timing with which the holding member holds the sheet bundle.

Further features of the present invention will become apparent from the following description of exemplary embodiments (with reference to the attached drawings).

BRIEF DESCRIPTION OF THE DRAWINGS

FIG. 8 is a timing chart useful in explaining sheet processing according to a first embodiment of the invention, which is carried out by the finisher appearing in FIG. 2.

FIG. 15 is view showing a table (data) of the thicknesses of sheet bundles with respect to the sheet type and the number of the sheets.

DESCRIPTION OF THE EMBODIMENTS

The present invention will now be described in detail with reference to the drawings showing an embodiment thereof.

Figure 1:
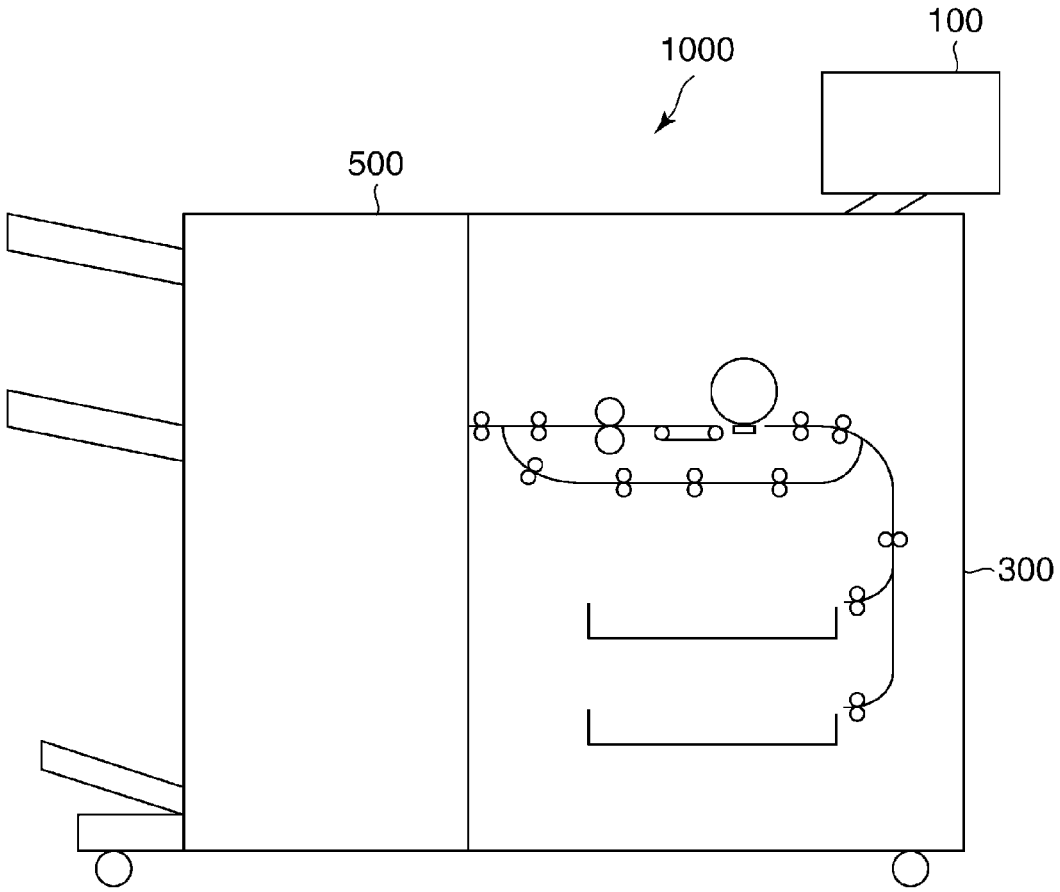
FIG. 1 is a view schematically showing an arrangement of an image forming system having a finisher which is a sheet processing apparatus according to an embodiment of the present invention.

FIG. 1 is a view schematically showing an arrangement of an image forming system having a finisher which is a sheet processing apparatus according to an embodiment of the present invention. The image forming system 1000 has a console 100 for a user to set the details of processing and others, a printer unit 300 that forms images on sheets according to settings, and a finisher 500 that carries out various types of post processing on sheets with images formed thereon.

Figure 2:
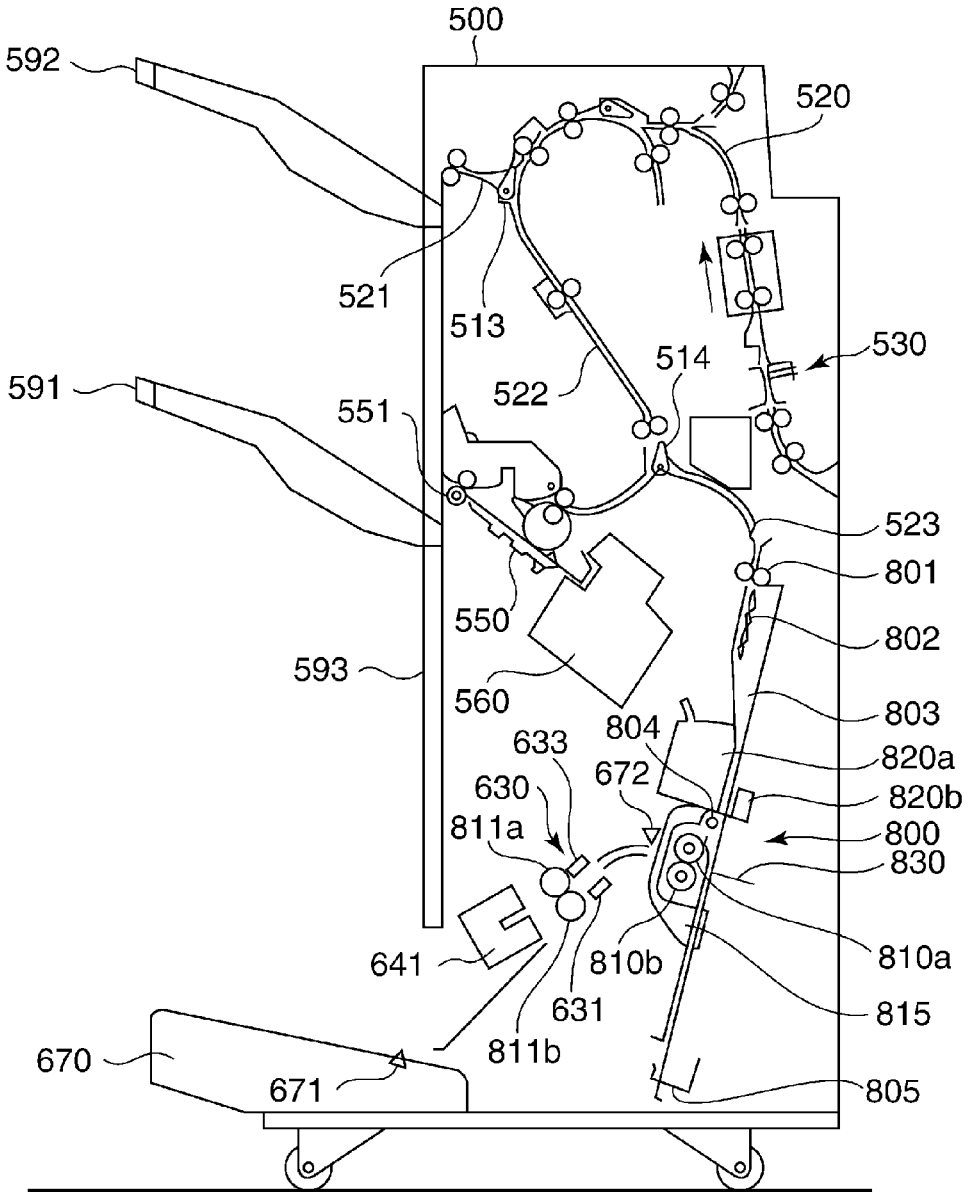
FIG. 2 is a cross-sectional view showing an arrangement of the finisher appearing in FIG. 1.

FIG. 2 is a cross-sectional view showing an arrangement of the finisher 500. The finisher 500 captures sheets from the printer unit 300 and carries out a process to align a plurality of captured sheets and bind them as one sheet bundle, a stapling process (stitching process) to staple a trailing end of a sheet bundle, a sorting process, a non-sorting process, or the like. A sheet inlet of a conveying path 520 in the finisher 500 is provided with a sheet sensor (not shown) that detects sheets received from the printer unit 300 by the finisher 500. A CPU 502 (see FIG. 6) counts the number of sheets brought into the finisher 500 using output signals from the sheet sensor.

A punch unit 530 is provided part way along the conveying path 520 in the finisher 500. The punch unit 530 carries out a punching process on trailing ends of conveyed sheets as the need arises. A flapper 513 is provided at an end of the conveying path 520. The flapper 513 switches the path between an upper sheet discharging path 521, which is joined to a downstream end of the conveying path 520, and a lower sheet discharging path 522. The upper sheet discharging path 521 discharges sheets onto an upper stack tray 592. On the other hand, the lower sheet discharging path 522 discharges sheets onto a processing tray 550. Sheets discharged onto the processing tray 550 are sequentially stored in the form of a bundle while being aligned, and subjected to a sorting process, a stapling process, and so on according to settings configured via the console 100, and then discharged onto one of stack trays 591 and 592 by a bundle sheet discharging roller pair 551.

It should be noted that the stapling process is carried out by a stapler 560, which is movable in a sheet width direction (direction parallel to a sheet surface and perpendicular to a sheet conveyance direction) and configured to be capable of stapling sheets at arbitrary positions thereof. The stack trays 591 and 592 are vertically movable, and the upper stack tray 592 receives sheets from the upper sheet discharging path 521 and the processing tray 550, and the lower stack tray 591 receives sheets from the processing tray 550. Thus, a number of sheets can be stacked on the stack trays 591 and 592, and trailing ends of sheets stacked on the stack trays 591 and 592 are guided by a vertically-extending trailing-end guide 593 so that the sheets can be aligned.

A sheet switched to the right-hand side as viewed in FIG. 2 by a switching flapper 514 provided part way along the lower sheet discharging path 522 is sent to a saddle binding unit 800 via a saddle sheet discharging path 523.

The sheet is passed to a saddle inlet roller pair 801 and brought into a housing guide 803 through a bring-in entrance selected by a flapper 802 actuated by a solenoid. The sheet brought into the housing guide 803 is conveyed by a sliding roller 804 until a leading end thereof abuts on a movable sheet positioning member 805. It should be noted that the saddle inlet roller pair 801 and the sliding roller 804 are driven by a saddle inlet conveying motor M1 (see FIG. 7).

A stapler, which is disposed so as to face across the housing guide 803, is provided part way along the housing guide 803. The stapler is divided into a driver 820*a* which sticks out a needle, and an anvil 820*b* that bends the pushed-out needle. The sheet positioning member 805 is caused to freely move by a positioning motor M2 (see FIG. 7), and changes its position according to a sheet size. When a sheet is brought in, the sheet positioning member 805 stops at such a position that a central part of the sheet comes to a position to be stapled by the stapler.

A pair of folding rollers 810*a* and 801*b* are provided downstream of the stapler comprised of the driver 820*a* and the anvil 802*b*, and a projecting member 830 is provided at such a position as to face the pair of folding rollers 810*a* and 801*b*. The projecting member 830 has a home position at which it is retracted from the housing guide 803, and projects by a pushing motor M3 (see FIG. 7) toward a sheet bundle housed in the housing guide 803. Thus, the sheet bundle is folded while being pushed into a nip of the folding rollers 810*a* and 810*b*, and thereafter, the projecting member 830 returns to the home position.

It should be noted that a force (pressure) for creasing a sheet bundle is applied between the folding rollers 810*a* and 810*b* by a spring (not shown) and the creased sheet bundle is conveyed to a flattening processing unit, to be described later.

Figure 7:
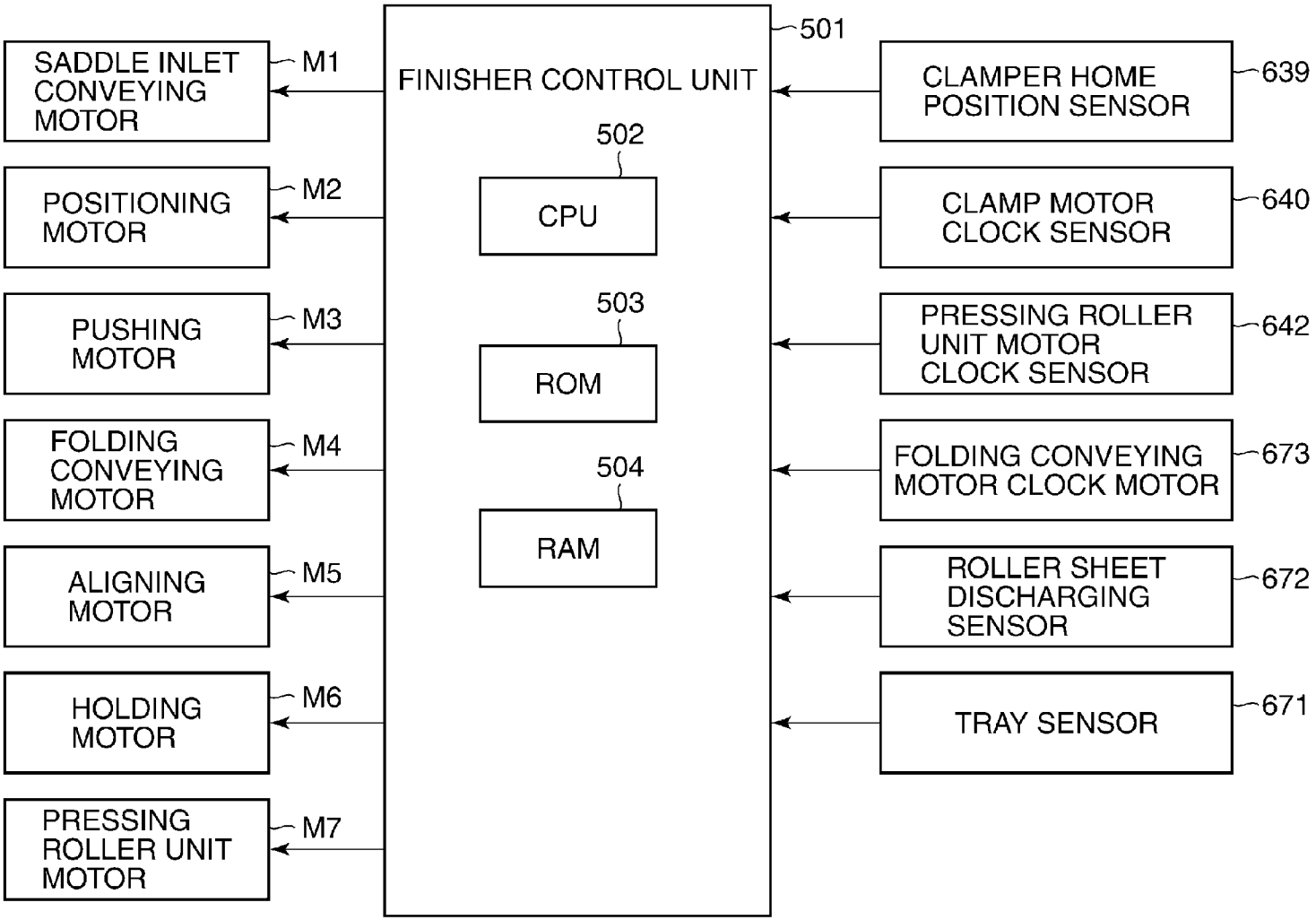
FIG. 7 is a block diagram showing a control system of the finisher appearing in FIG. 2.

The pair of folding rollers 810*a* and 810*b* are rotated at a uniform speed by a folding conveying motor M4 (see FIG. 7). When a sheet bundle stapled by the driver 820*a* and the anvil 820*b* is to be folded, the sheet positioning member 805 is lowered a predetermined distance from a position at which the sheet bundle has been stapled so that the stapled position of the sheet bundle can be brought to the nip of the folding rollers 810*a* and 801*b*. As a result, the sheet bundle can be folded about a position where it has been stapled.

An aligning plate pair 815 having surfaces sticking out to the housing guide 803 around outer peripheries of the folding rollers 810*a* and 801*b* plays a role in aligning sheets housed in the housing guide 803. The aligning plate pair 815 is moved to sandwich a sheet bundle in a sheet width direction by an aligning motor M5 (see FIG. 7) to position the sheet bundle in the sheet width direction.

A roller sheet discharging sensor 672 acting as a leading end detecting unit that detects a leading end of a sheet bundle detects discharging of a sheet bundle from the pair of folding rollers 810*a* and 810*b* by detecting a leading end of the sheet bundle. It should be noted that a folding conveying motor clock sensor 673 (see FIG. 7) that detects rotation of the folding conveying motor M4 is attached to a counter-output shaft of the folding conveying motor M4 that rotates the pair of folding rollers 810*a* and 810*b*. The folding conveying motor clock sensor 673 acts as a conveyance amount detecting unit that detects the amount by which a sheet bundle is conveyed, and is capable of detecting the amount by which a sheet bundle is conveyed by the folding conveying motor M4 based on an output from the folding conveying motor clock sensor 673.

Figure 3:
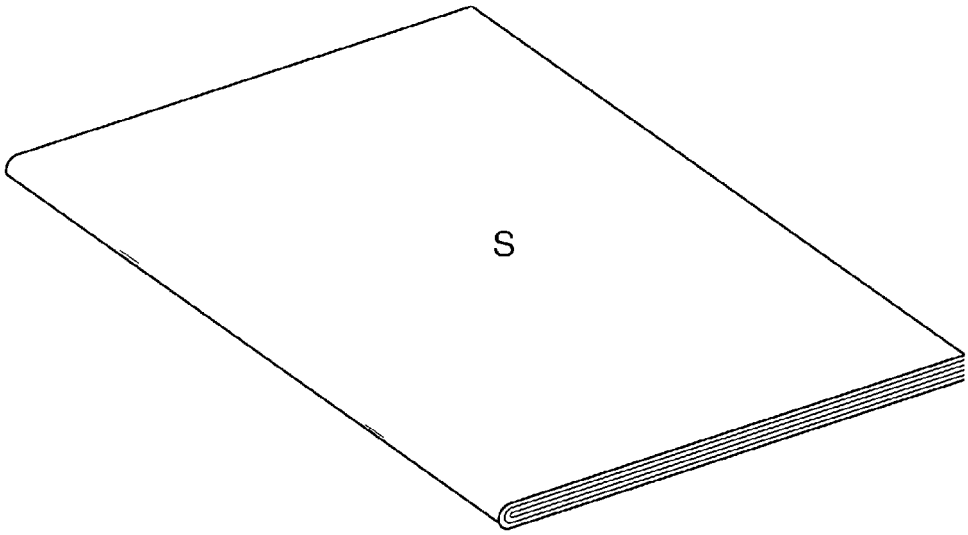
FIG. 3 is a perspective view showing an appearance of a sheet bundle produced by a saddle binding unit constituting the finisher appearing in FIG. 2.

The saddle binding unit 800 arranged as described above forms a sheet bundle S having an appearance as shown in a perspective view of FIG. 3.

The flattening processing unit is disposed downstream of the pair of folding rollers 810*a* and 810. The flattening processing unit has a holding unit 630 having holding plates 633 and 631 that hold the sheet bundle S from above and below. The flattening processing unit also has a pair of second holding conveying rollers 811*a* and 811*b* that convey the sheet bundle S, and a pressing roller unit 641 that brings a fold top of the sheet bundle S into pressure.

Figure 4:
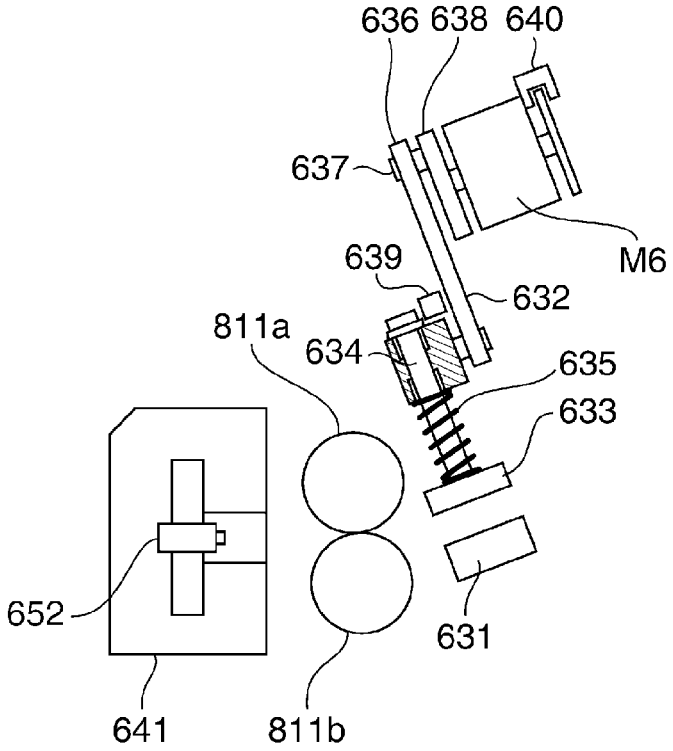
FIG. 4 is a side view showing an arrangement of a holding unit which a flattening processing unit constituting the finisher appearing in FIG. 2 has.

FIG. 4 is a side view showing an arrangement of the holding unit 630. In the holding unit 630, the lower holding plate 631 which is a first holding plate is fixed to a frame (not shown) of the finisher 500, and the upper holding plate 633 which is a second holding plate moves up and down to come into contact with and draw away from the lower holding plate 631. A holding base 632 is moved up and down via links 636, 637, and 638 by a holding motor M6. The upper holding plate 633 is connected to the holding base 632 by a slide connecting member 634, and a compression spring 635 is disposed around an outer periphery of the slide connecting member 634.

When the holding base 632 is at an upper position, the upper and lower holding plates 633 and 631 are away from each other, and the sheet bundle S is conveyed between the upper the upper and lower holding plates 633 and 631 by the pair of conveying rollers 811*a* and 811*b*. When the holding base 632 is moved to a lower position with the sheet bundle S being conveyed between the upper the upper and lower holding plates 633 and 631, the compression spring 635 expands and contracts according to the thickness of the sheet bundle S, which causes the sheet bundle S to be firmly fixed to the upper and lower holding plates 633 and 631.

It should be noted that a clamper home position sensor 639 appearing in FIG. 4 detects a home position of the holding base 632. Also, a clamp motor clock sensor 640 appearing in FIG. 4 detects rotation of the holding motor M6, thus detecting the amount by which the upper holding plate 633 is moved.

Figure 5:
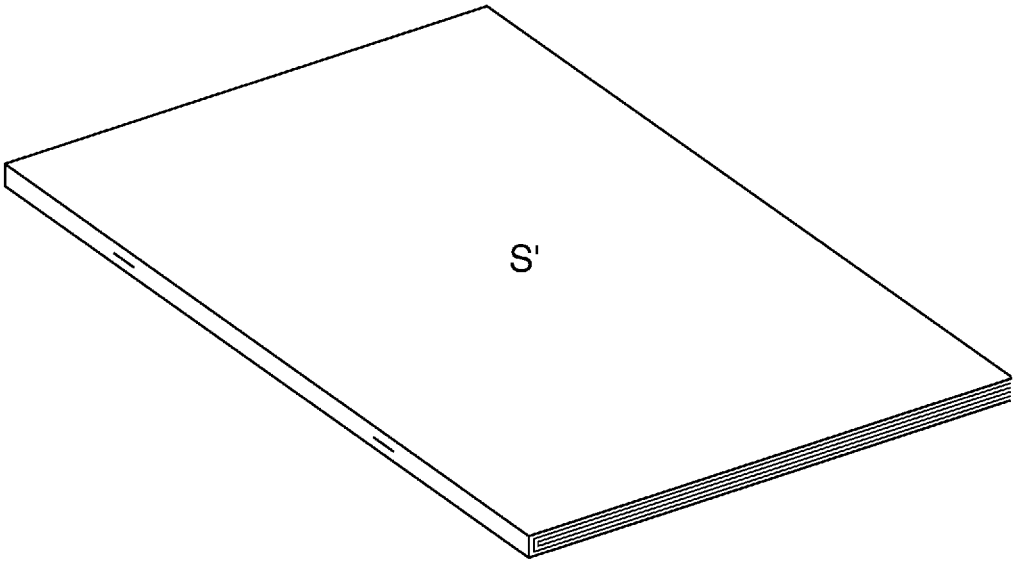
FIG. 5 is a perspective view showing an appearance of a sheet bundle flattened by the flattening processing unit appearing in FIG. 4.

The pressing roller unit 641 has a pressing roller 652 that brings the fold top into pressure. The pressing roller 652 flattens the fold top of the sheet bundle S by moving along the fold of the sheet bundle S while pressing the fold top of the sheet bundle S reversely to a conveyance direction of the sheet bundle. As a result, a sheet bundle S' with its fold top flattened having an appearance as shown in a perspective view of FIG. 5 is produced.

It should be noted that a pressing roller unit motor clock sensor 642 that detects rotation of a pressing roller unit motor M7 (see FIG. 7) that drives the pressing roller unit 641 is mounted on the pressing roller unit motor M7 (see FIG. 7).

After the flattening by the pressing roller unit 641 is completed, the folding conveying motor M4 discharges the sheet bundle S' onto a tray 670 (see FIG. 2), and a tray sensor 671 (see FIG. 2) detects this.

Figure 6:
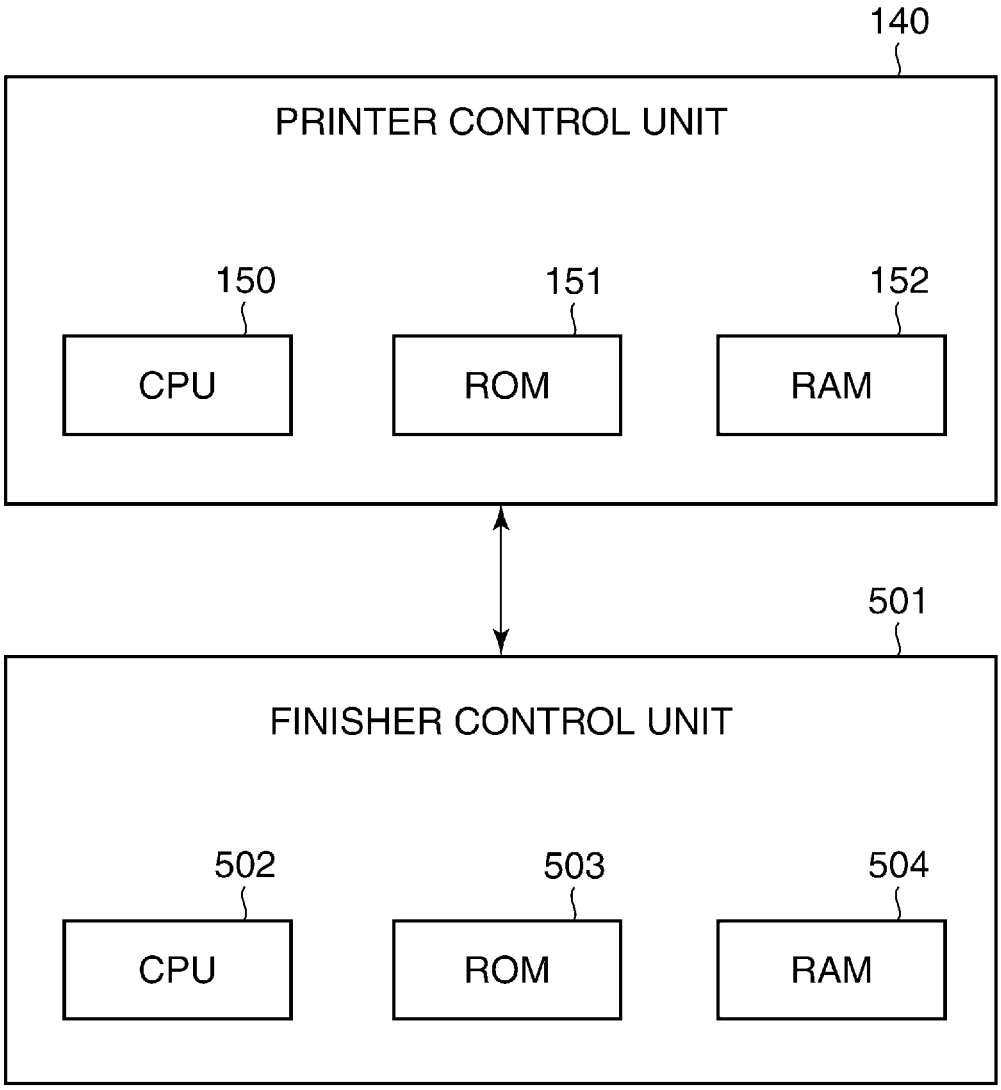
FIG. 6 is a block diagram showing a control system of the image forming system appearing in FIG. 1.

FIG. 6 is a block diagram showing a control system of the image forming system 1000. A control block of the image forming system 1000 is broadly divided into a printer control unit 140 that controls the printer unit 300, and a finisher control unit 501 that controls the finisher 500. It should be noted that the console 100 is controlled by the printer control unit 140.

The printer control unit 140 has a CPU 150, a ROM 151, and a RAM 152. The CPU 150 expands control programs stored in the ROM 151 into a work area of the RAM 152 and executes them, thus controlling various actuators and others constituting the printer unit 300 and also controlling the finisher control unit 501.

The finisher control unit 501 has a CPU 502, a ROM 503, and a RAM 504. In accordance with instructions from the printer control unit 140, the CPU 502 expands control programs stored in the ROM 503 into a work area of the RAM 504 and executes them, thus controlling various actuators and others provided in the finisher 500.

FIG. 7 is a block diagram showing a control system of the finisher 500. In accordance with control programs stored in the ROM 503 and input signals from various sensors appearing in FIG. 7, the CPU 502 controls the operation of various motors appearing in FIG. 7. It should be noted that various sensors and various motors shown in FIG. 7 have already been described, and therefore, description thereof is omitted here.

FIG. 8 is a timing chart useful in explaining sheet processing according to a first embodiment of the invention. Specifically, the timing chart of FIG. 8 shows operation from when sheets are stacked on the sheet positioning member 805 to when a sheet bundle is discharged onto the tray 670. It should be noted that in a timing chart of the holding motor M6 in FIG. 8, a solid line pertains to the present embodiment, and a broken line pertains to the conventional method.

The CPU 502 drives the saddle inlet conveying motor M1, and after the sliding roller 804 brings a last sheet constituting a sheet bundle to the sheet poisoning member 805, causes the aligning motor M5 to align the sheet bundle. After the sheet bundle is thus completely stacked in the housing guide 803, the CPU 502 carries out a stapling process on the sheet bundle using the stapler comprised of the driver 820*a* and the anvil 820*b*, and causes the positioning motor M2 to lower the sheet positioning member 805 to a predetermined position.

Then, to fold the sheet bundle in half, the CPU 502 drives the pushing motor M3 to fold the sheet bundle in the middle by the projecting member 830 and push the sheet bundle between the pair of folding rollers 810*a* and 810*b*. When the sheet bundle S (see FIG. 3) is thus produced, the CPU 502 drives the folding conveying motor M4 to convey the sheet bundle S between the upper and lower holding plates 633 and 631. When a trailing end of the sheet bundle S comes out of the folding rollers 810*a* and 810*b*, the CPU 502 drives the positioning motor M2 to return the sheet positioning member 805 to its original position. As a result, stacking of sheets constituting the next sheet bundle on the sheet positioning member 805 can be started.

The CPU 502 drives the holding motor M6 to move the upper holding plate 633, and when the sheet bundle S is held by the upper and lower holding plates 633 and 631, the CPU 502 drives the pressing roller unit motor M7 to move the pressing roller unit 641 along a fold top of the sheet bundle S. As a result, the curved fold top of the sheet bundle S is flattened to produce the sheet bundle S' (see FIG. 5). After this flattening process is completed, the CPU 502 drives the holding motor M6 to cause the upper and lower holding plates 633 and 631 to release the sheet bundle S', and then drives the folding conveying motor M4 to discharge the sheet bundle S' onto the tray 670.

In this sequential process, the smaller the number of sheets constituting a sheet bundle, the earlier the timing with which stacking of next sheet bundle appearing in FIG. 8 is completed. However, the operation of the projecting member 830 for the next sheet bundle by the pushing motor M3 cannot be started unless discharge of a sheet bundle through operation of the folding conveying motor M4 is completed (see a broken line in FIG. 8).

Accordingly, in the present embodiment, movement of the upper holding plate 633 by the holding motor M6 is started so that the upper and lower holding plates 633 and 631 can start holding a sheet bundle a time period Δt earlier than a timing of the folding motor M4 stopping as indicated by a solid line in FIG. 8. As a result, projection of the next sheet bundle by the projecting member 830 can be started by the pushing motor M3 a time period Δt earlier than ever before, and therefore, productivity can be enhanced. Details thereof will be described later with reference to FIG. 11 and other figures.

Figure 9A:
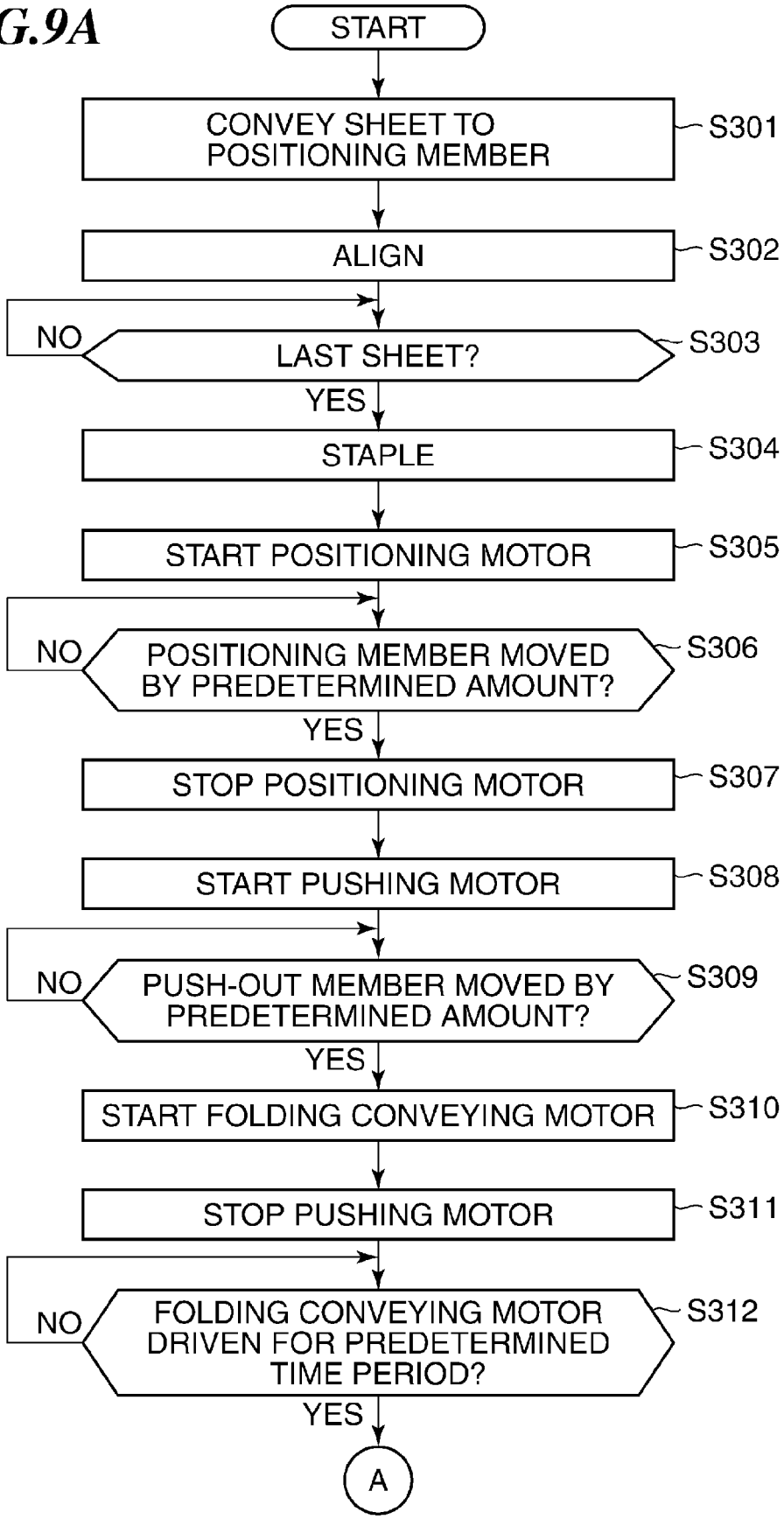
FIGS. 9A and 9B are flowcharts showing processes carried out according to the timing chart of FIG. 8.
Figure 9B:
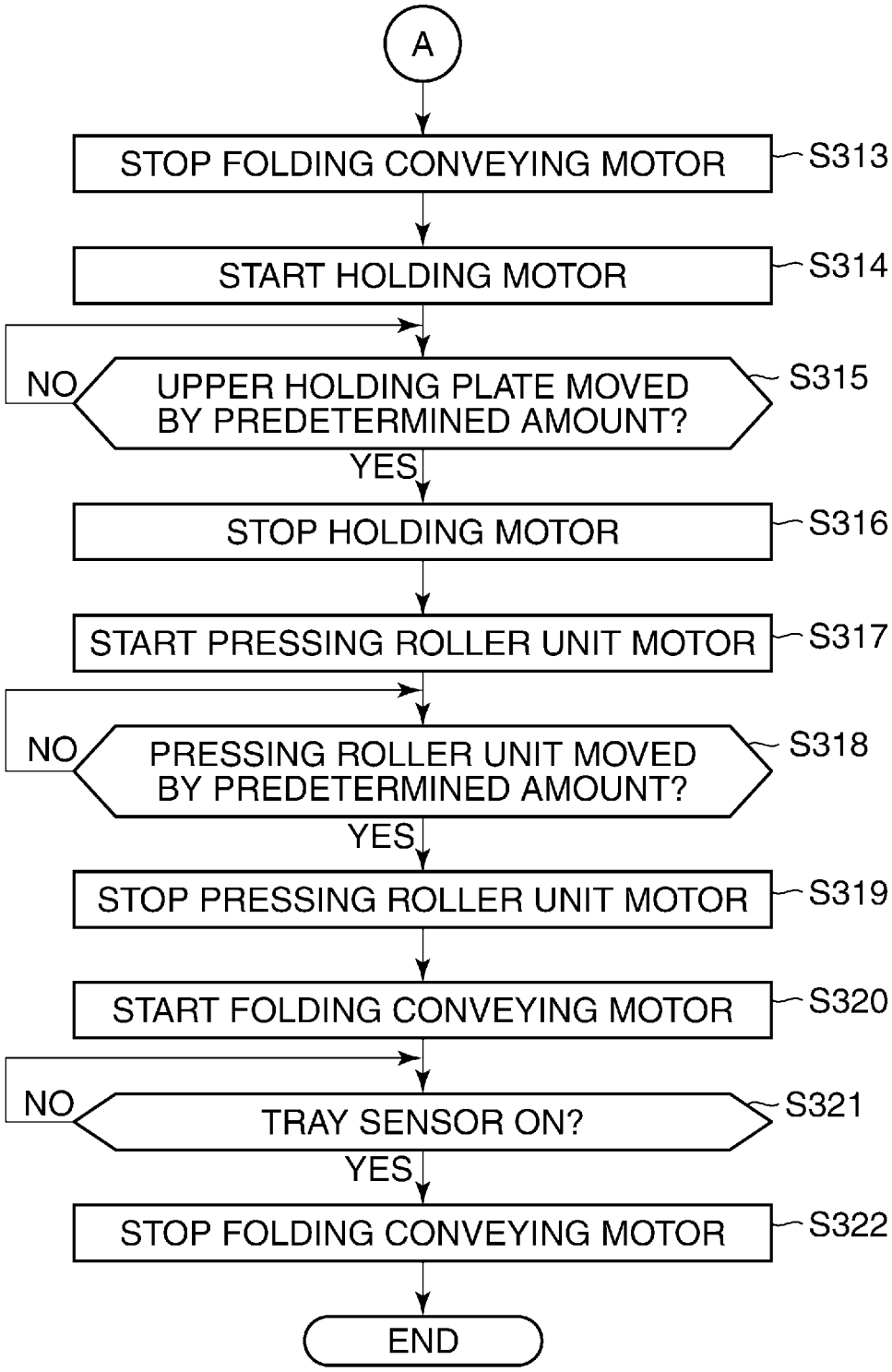

FIGS. 9A and 9B are flowcharts showing processes carried out according to the timing chart of FIG. 8 in a case where the holding motor M6 moves with timing indicated by the broken line (that is, the conventional method). The processes in this flowchart are carried out by the CPU 502 of the finisher control unit 501.

When a sheet is conveyed to the positioning member 805 (step S301), the CPU 502 drives the aligning motor M5 to move the aligning plate pair 815, thus aligning the sheet (step S302). Then, the CPU 502 determines whether or not the sheet conveyed to the positioning member 805 is a last sheet of a bundle (step S303). When the sheet is not the last sheet (NO to the step S303), the CPU 502 repeatedly carries out the determination in the step S303 until the sheet is the last sheet. When the sheet is the last sheet (YES to the step S303), the CPU 502 carries out a stapling process on the sheet bundle (step S304).

Then, the CPU 502 starts the positioning motor M2 (step S305) to move the positioning member 805, and determines whether or not the positioning member 805 has moved by a predetermined amount (step S306). The CPU 502 repeatedly carries out the determination in the step S306 (NO to the step S306) until the positioning member 805 has moved by the predetermined amount. When the positioning member 805 has moved by the predetermined amount (YES to the step S306), the CPU 502 stops the positioning motor M2 (step S307). It should be noted that the amount by which the positioning member 805 is moved is stored as data in advance in the ROM 503.

Then, the CPU 502 starts the pushing motor M3 (step S308) to move the projecting member 830, and determines whether or not the projecting member 830 has moved by a predetermined amount (step S309). The CPU 502 repeatedly carries out the determination in the step S306 (NO to the step S309) until the projecting member 830 has moved by the predetermined amount. When the projecting member 830 has moved by the predetermined amount (YES to the step S309), the CPU 502 starts the folding conveying motor M4 (step S310), and stops the pushing motor M3 (step S311). It should be noted that the amount by which the projecting member 830 is moved is stored as data in advance in the ROM 503.

After the step S311, the CPU 502 determines whether or not the folding conveying motor M4 has been driven for a predetermined time period (step S312). It should be noted that the predetermined time period for which the folding conveying motor M4 is driven is stored as data in advance in the ROM 503, and this predetermined time period is designated as a time period required for the sheet bundle to reach an area between the upper and lower holding plates 633 and 631. Thus, the CPU 502 repeatedly carries out the determination in the step S312 (NO to the step S312) until the predetermined time period has elapsed. Since the lapse of the predetermined time period is considered to allow the sheet bundle to reach an area between the upper and lower holding plates 633 and 631 (YES to the step S312), the CPU 502 stops the folding conveying motor M4 (step S313).

After the step S313, the CPU 502 starts the holding motor M6 (step S314), and determines whether or not the upper holding plate 633 has moved by a predetermined amount (step S315). The CPU 502 repeatedly carries out the determination in the step S315 (NO to the step S315) until the upper holding plate 633 has moved by the predetermined amount. When the upper holding plate 633 has moved by the predetermined amount (YES to the step S315), the CPU 502 stops the holding motor M6 (step S316).

After the step S316, the CPU 502 starts the pressing roller unit motor M7 (step S317), and determines whether or not the pressing roller unit 641 has moved by a predetermined amount (step S318). The CPU 502 repeatedly carries out the determination in the step S318 (NO to the step S318) until the pressing roller unit 641 has moved by the predetermined amount. When the pressing roller unit 641 has moved by the predetermined amount (YES to the step S318), the CPU 502 stops the pressing roller unit motor M7 (step S319).

Then, the CPU 502 starts the folding conveying motor M4 (step S320), and determines whether or not the tray sensor 671 has been turned on (step S321). The CPU 502 repeatedly carries out the determination in the step S321 (NO to the step S321) until the tray sensor 671 has been turned on. When the tray sensor 671 has been turned on (YES to the step S321), the CPU 502 stops the folding conveying motor M4 (step S322). Then, for the next sheet bundle, the CPU 502 carries out the same control from the step S301.

Figure 10:
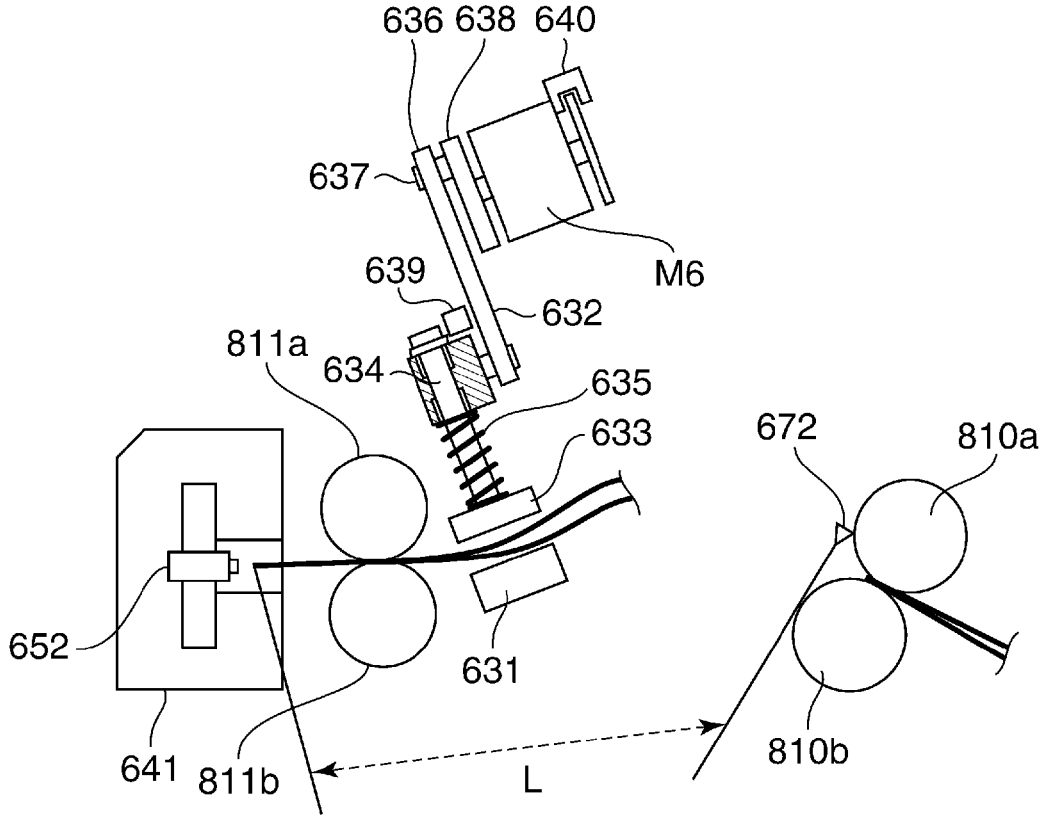
FIG. 10 is a side view schematically showing states before and after the sheet bundle is conveyed from the saddle binding unit to the flattening processing unit in the finisher appearing in FIG. 2.

Next, a detailed description will be given of the most characteristic part of sheet processing in the present embodiment, that is, the case where the holding motor M6 operates with timing indicated by the solid line in FIG. 8. FIG. 10 is a side view schematically showing states before and after the sheet bundle is conveyed from the saddle binding unit 800 to the flattening processing unit.

A sheet bundle S produced by the pair of folding rollers 810 and 810*b* folding sheets is conveyed toward the pressing roller unit 641 by the pair of second folding conveying rollers 811*a* and 811*b*. At this time, in the present embodiment, the sheet bundle S is conveyed a predetermined distance L so that a leading end thereof can come from a position at which the sheet bundle S is detected by the roller sheet discharging sensor 672 to the front of a position at which the sheet bundle S is to be processed by the pressing roller unit 641. This distance L is detected by the folding conveying motor clock sensor 673 detecting rotation of the folding conveying motor M4.

Figure 11:
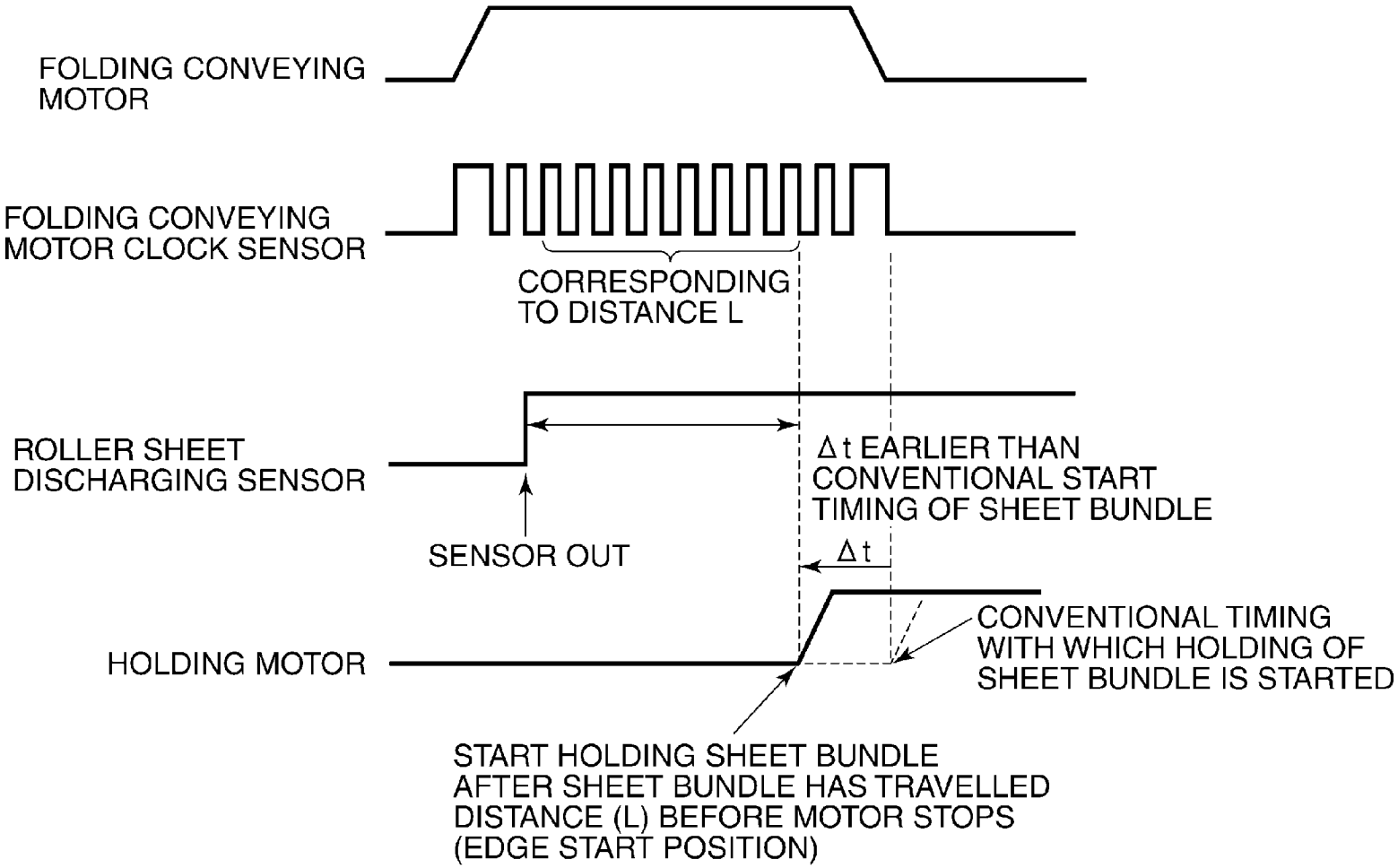
FIG. 11 is a timing chart showing conveyance of a sheet bundle by a pair of folding rollers and a pair of second folding conveying rollers, and holding of a sheet bundle by upper and lower holding plates.

FIG. 11 is a timing chart showing conveyance of a sheet bundle by the pair of folding rollers 810*a* and 810*b* and the pair of second folding conveying rollers 811*a* and 811*b*, and holding of the sheet bundle by the upper and lower holding plates 633 and 631. Among the processes in the steps S310 to S316 in FIGS. 9A and 9B, parts concerned with the operation of the folding conveying motor M4 and the holding motor M6 are replaced by steps S101 to S105 in FIG. 12.

First, the CPU 502 starts the folding conveying motor M4, and after the roller sheet discharging sensor 672 detects a sheet bundle S, causes the pair of folding rollers 810*a* and 810*b* and the pair of second folding conveying rollers 811*a* and 811*b* to convey the sheet bundle S. When the sheet bundle S has been conveyed the distance L (see FIG. 10) determined in advance according to a mechanical configuration of the saddle binding unit 800, the CPU 502 causes the upper and lower holding plates 633 and 611 to start holding the sheet bundle S. Namely, at the time when the sheet bundle S has been conveyed the distance L, the CPU 502 starts the holding motor M6 to start moving the upper holding plate 633 while driving the folding conveying motor M4.

Thus, in the present embodiment, a holding operation by the holding plates 633, 631 is started before the sheet bundle reaches a position at which the flattening process is carried out. Accordingly, the processing time can be reduced because holding of the sheet bundle S is started the time period Δt earlier than in the case where holding of the sheet bundle S is started after the sheet bundle S is completely stopped by stopping the folding conveying motor M4 as in the conventional method. It should be noted that the distance L is determined such that when the sheet bundle S is held by the holding unit 630, the sheet bundle S has been conveyed to the position at which it is to be processed by the pressing roller unit 641.

Figure 12:
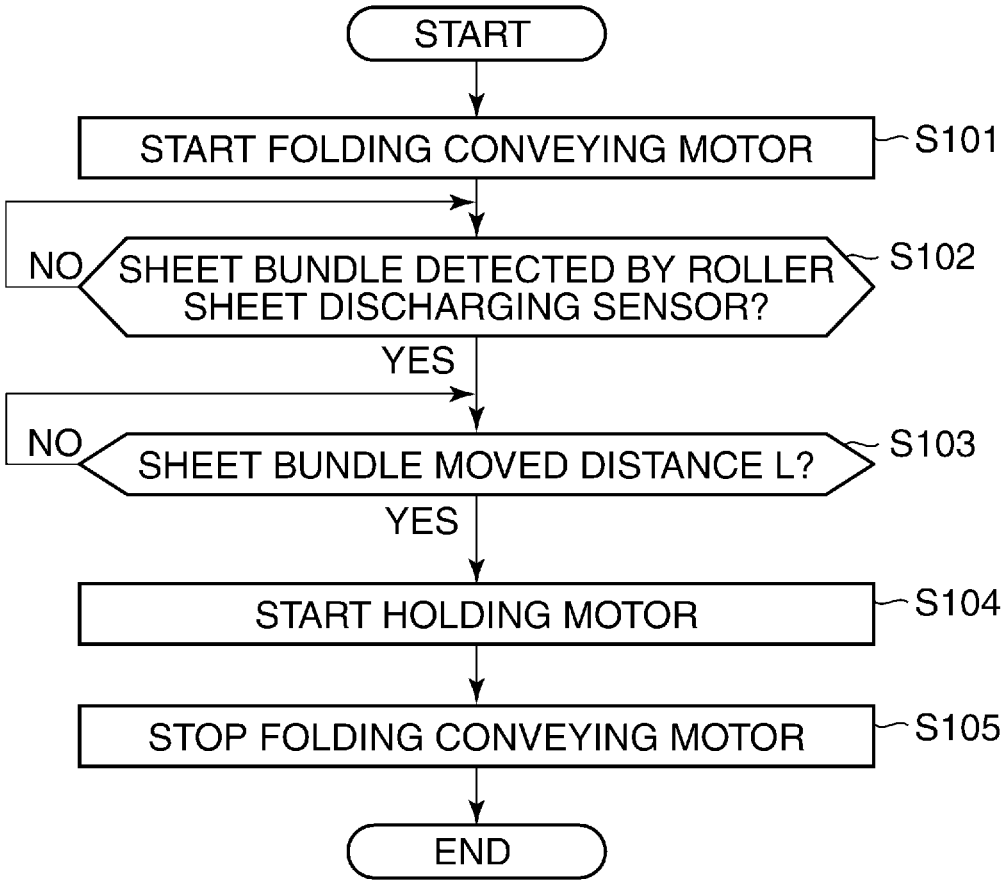
FIG. 12 is a flowchart showing a process carried out according to the timing chart of FIG. 11.

FIG. 12 is a flowchart showing a process carried out according to the timing chart of FIG. 11. The CPU 502 starts the folding conveying motor M4 (step S101), and determines whether or not the roller sheet discharging sensor 672 has detected a leading end of the sheet bundle S (step S102). The CPU 502 repeatedly carries out the determination in the step S102 (NO to the step S102) until the roller sheet discharging sensor 672 has detected the leading end of the sheet bundle S. When the roller sheet discharging sensor 672 has detected the leading end of the sheet bundle S (YES to the step S102), the CPU 502 determines whether or not the sheet bundle S has been conveyed the distance L from the roller sheet discharging sensor 672 (step S103).

The CPU 502 repeatedly carries out the determination in the step S103 (NO to the step S103) until the sheet bundle S has been conveyed the distance L. When the sheet bundle S has been conveyed the distance L (YES to the step S103), the CPU 502 starts the holding motor M6 to cause the upper and lower holding plates 633 and 631 to start holding the sheet bundle S (step S104), and then stops the folding conveying motor M4 (step S105).

Thus, according to the present embodiment, the processing time for the flattening process can be reduced by the time period Δt as compared to the conventional method in which holding of the sheet bundle S by the upper and lower holding plates 633 and 631 is started after the sheet bundle S is completely stopped.

Figure 13:
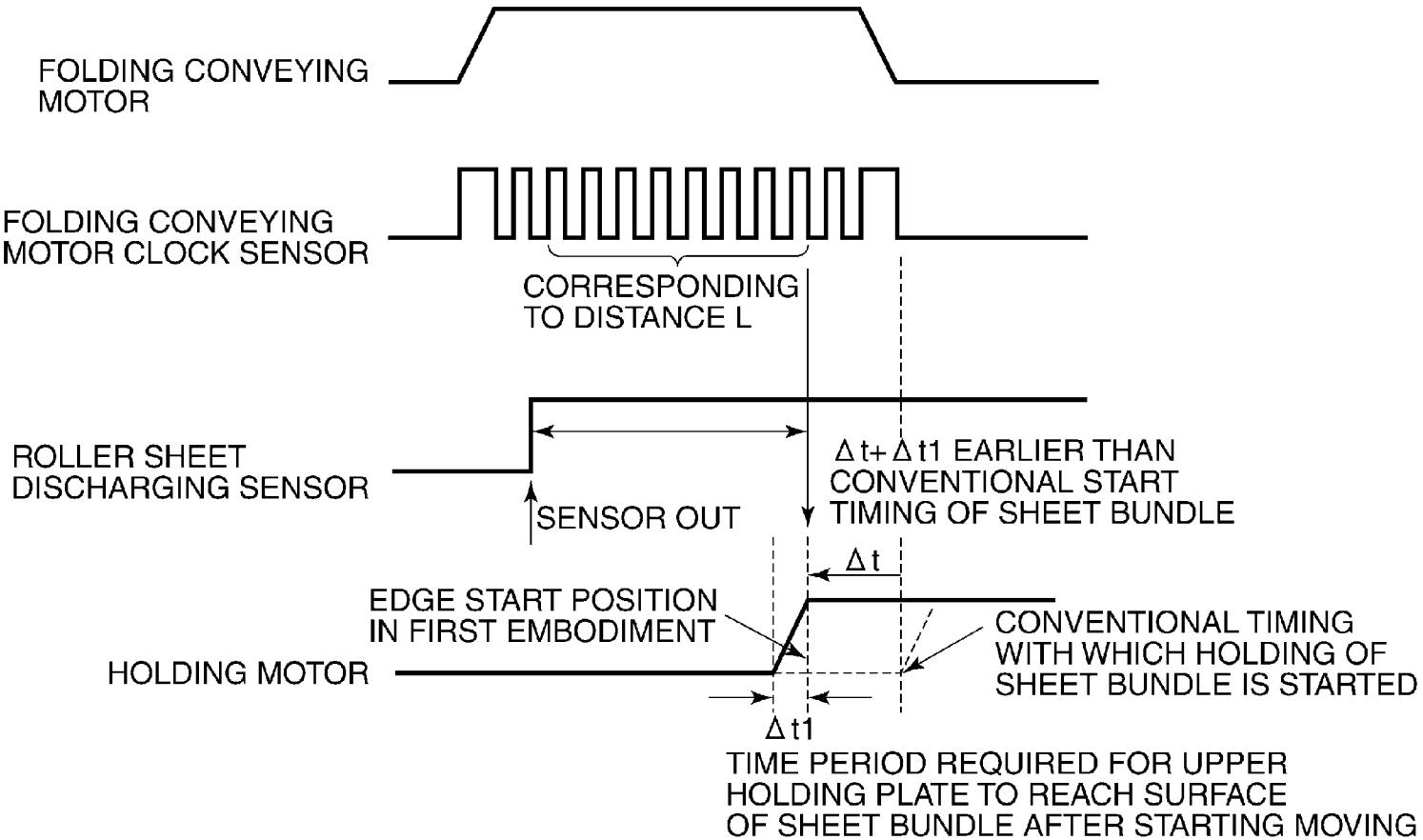
FIG. 13 is a timing chart useful in explaining sheet processing according to a second embodiment of the invention, which is carried out by the finisher.

FIG. 13 is a timing chart useful in explaining sheet processing by the finisher 500 according to a second embodiment of the invention. The CPU 502 starts the folding conveying motor M4 to start conveyance of the sheet bundle S by the pair of folding rollers 810*a* and 810*b* and the pair of second folding conveying rollers 811*a* and 811*b*. The CPU 502 starts the holding motor M4 to drive the upper holding plate 633 a time period Δt1 earlier than the time at which the sheet bundle S has been conveyed the distance L after the roller sheet discharging sensor 672 had detected the sheet bundle S. Thus, in the present embodiment, holding of the sheet bundle S by the upper and lower holding plates 633 and 631 can be started the time period Δt1 earlier than in the present embodiment.

Figure 14:
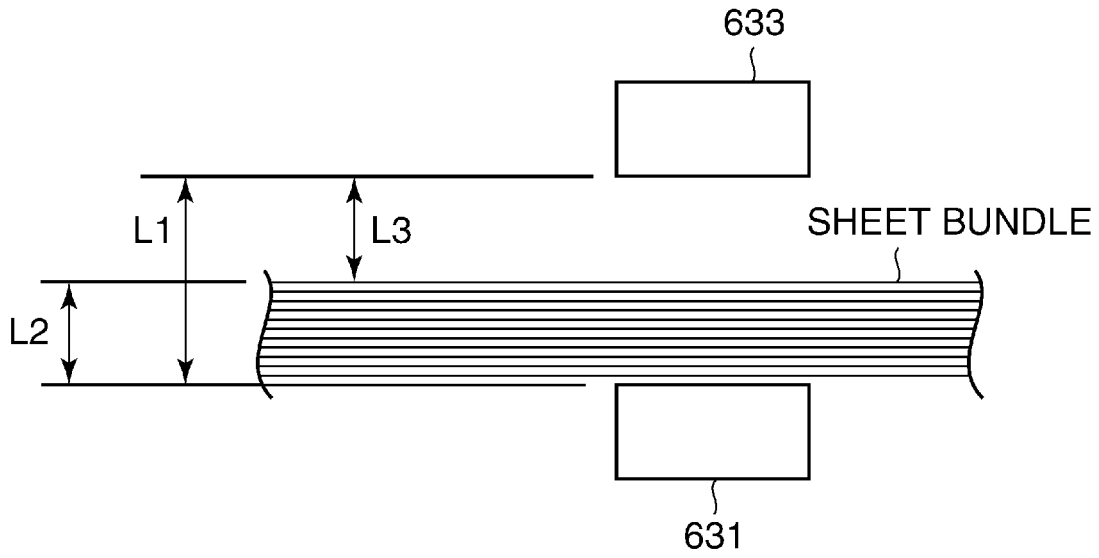
FIG. 14 is a side view schematically showing a state before a sheet bundle is held by the upper and lower holding plates in the finisher appearing in FIG. 2.

The time period Δt1 is designated by a time period required for the upper holding plate 633 to actually reach a surface of the sheet bundle S after being started by the holding motor M6, and a description will now be given of how the time period Δt1 is calculated with reference to FIGS. 14 and 15. FIG. 14 is a side view schematically showing a state before the sheet bundle S is held by the upper and lower holding plates 633 and 631. FIG. 15 is a table (data) showing the thicknesses of sheet bundles with respect to each of the sheet type and the number of sheets handled by the finisher 500, and the thicknesses of sheet bundles S are experimentally or empirically obtained. The data in FIG. 15 is stored in the ROM 503.

In FIG. 14, an interval L1 between the upper and lower holding plates 633 and 631 is a known value, and a thickness L2 of a sheet bundle S can be obtained from the data in FIG. 15, and therefore, a distance L3 from the upper holding plate 633 to a surface of the sheet bundle S can be obtained according to the following mathematical expression, "L3=L1−L2". Thus, the time period Δt1 required for the upper holding plate 633 to abut on the sheet bundle S after being started can be obtained according to the following mathematical expression, "Δt1=(L1−L2)/V", where V denotes the moving speed of the holding plate 633.

The processing time can be reduced by a time period (Δt1+Δt1), which is obtained by adding together the time period Δt1 calculated as described above and the time period Δt obtained in the first embodiment, as compared to the conventional method.

Figure 16:
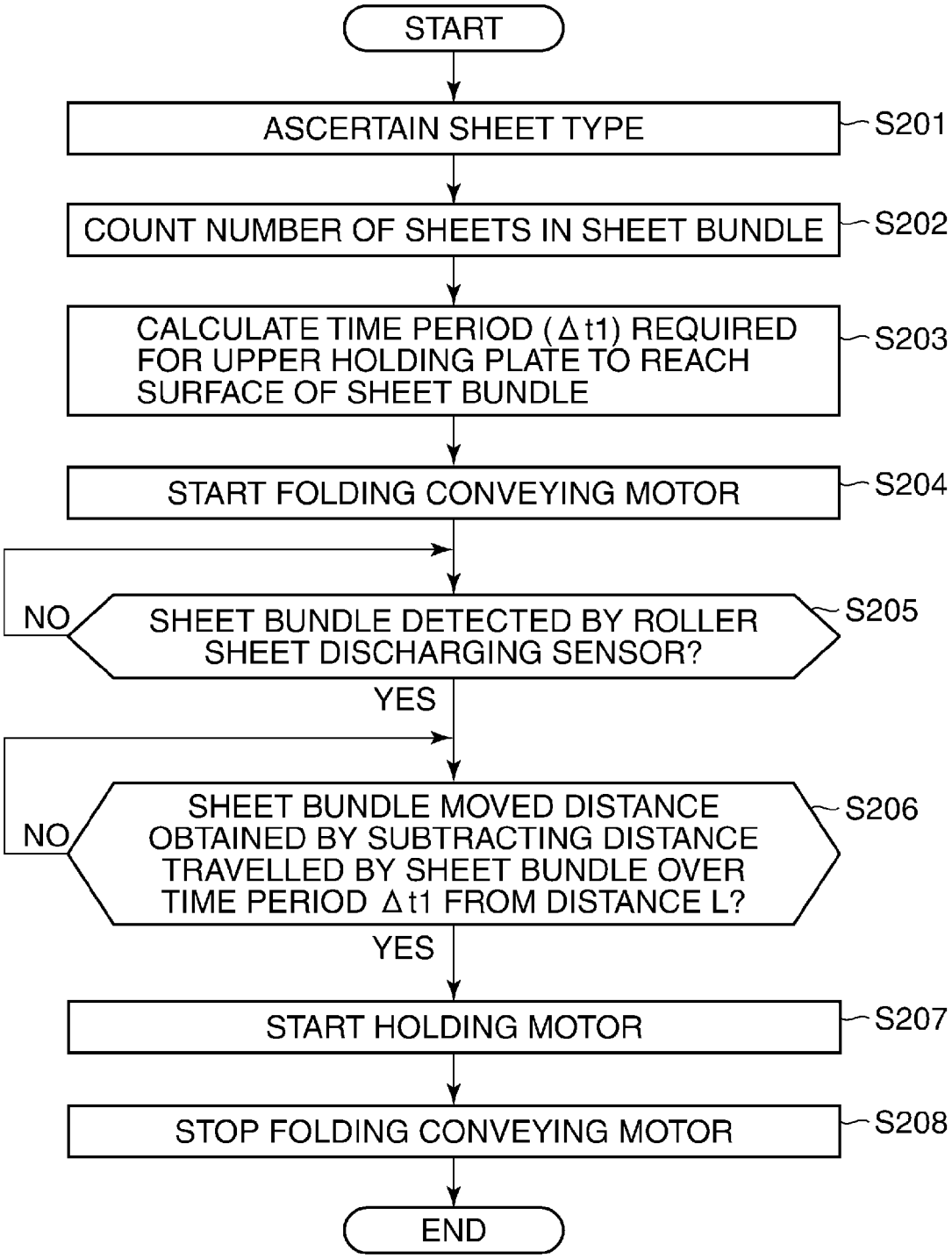
FIG. 16 is a flowchart useful in explaining a process carried out according to the timing chart of FIG. 13.
Figure 17A:
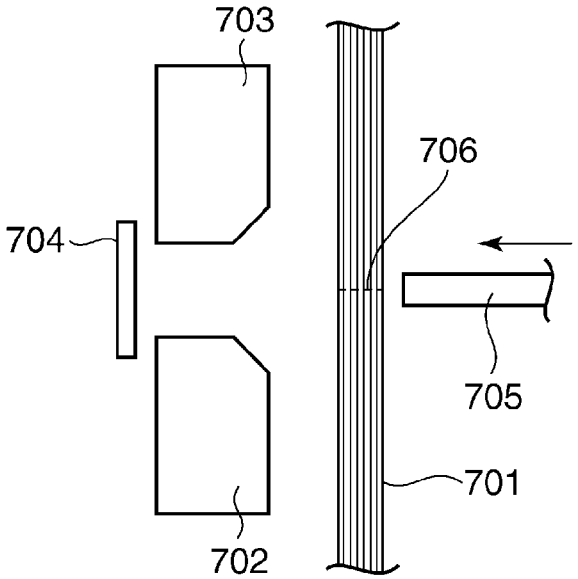
FIG.17A PRIOR ART
FIGS. 17A and 17B are views schematically showing an arrangement of a conventional apparatus that flattens and squares a fold top of a poorly-folded sheet bundle, and showing how the conventional apparatus operates.
Figure 17B:
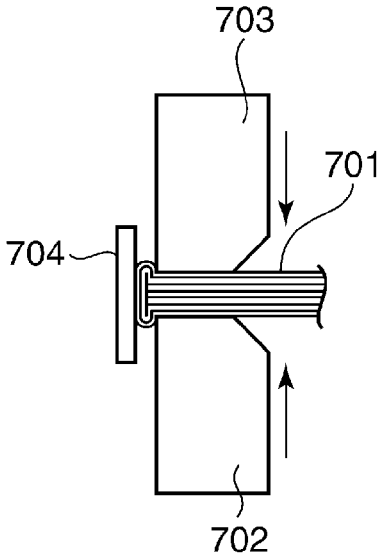
FIG.17B PRIOR ART

FIG. 16 is a flowchart useful in explaining a process carried out according to the timing chart of FIG. 13. The CPU 502 acts as a sheet type detecting unit to ascertain a sheet type set via the console 100 (step S201). Also, the CPU 502 acts as a number-of-sheets detecting unit to count the number of sheets (the number of sheets constituting a sheet bundle S) conveyed to the positioning member 805 based on an output signal from the sheet detecting sensor (step S202).

The CPU 502 acts as a thickness calculating unit to obtain the thickness of the sheet bundle S by checking the sheet type and the number of sheets against the data in the table of FIG. 15 stored in the ROM 503. Then, the CPU 502 acts a movement amount calculating unit for the upper holding plate 633 to calculate a distance L3 travelled by the upper holding plate 633 to reach a surface of the sheet bundle S so as to hold the sheet bundle S (see FIG. 14). Further, the CPU 502 acts as a movement time calculating unit for the upper holding plate 633 to calculate the time period Δt1 required for the upper holding plate 633 to reach the surface of the sheet bundle S based on the distance L3 and the speed at which the upper holding plate 633 moves (step S203).

The CPU 502 then starts the folding conveying motor M4 (step S204) to start conveyance of the sheet bundle S, and determines whether or not the roller sheet discharging sensor 672 has detected a leading end of the sheet bundle S (step S205). The CPU 502 repeatedly carries out the determination in the step S205 (NO to the step S205) until the leading end of the sheet bundle S is detected. When the leading end of the sheet bundle S is detected (YES to the step S205), the CPU 502 determines whether or not a time period obtained by subtracting the time period Δt1 from the time period required for the sheet bundle S to travel the distance L has elapsed (step S206). Namely, in the step S206, it is determined whether or not the sheet bundle S has travelled a predetermined distance obtained by subtracting from the distance L a distance traveled by the sheet bundle S over the time period Δt1. The predetermined distance is determined such that at a later time, when the sheet bundle S is held by the holding unit 630, the sheet bundle S has been conveyed to a position at which it to be processed by the pressing roller unit 641.

The CPU 502 repeatedly carries out the determination in the step S206 (NO to the step S206) until the sheet bundle S has moved the predetermined distance. When the sheet bundle S has moved the predetermined distance (YES to the step S296), the CPU 502 starts the holding motor M6 to cause the upper holding motor 633 to start holding the sheet bundle S (step S207). At the same time, the CPU 502 stops the operation of the folding conveying motor M4 (step S208).

Thus, according to the present embodiment, the time period required for the flattening process can be reduced by Δt+Δt1 as compared to the conventional method.

In the above respective embodiments, the holding plate 633 is movable, whereas the holding plate 631 is fixed; however, both the holding plates 633 and 631 may be movable.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-092015 filed Apr. 18, 2011, which is hereby incorporated by reference herein in its entirety.

What is claimed is:

1. A sheet processing apparatus comprising:

a conveying unit configured to convey a folded sheet bundle to a processing position;

a holding unit, comprising a first holding member and a second holding member, configured to hold the sheet bundle conveyed by said conveying unit in a thickness direction of the sheet bundle by movement of at least one of the first holding member or the second holding member;

a pressing unit configured to press a fold top of the sheet bundle held by said holding unit at the processing position; and a control unit configured to cause, while the sheet bundle is being conveyed by the conveying unit, said holding unit to start moving the at least one of the first holding member or the second holding member along the thickness direction of the sheet bundle to hold the sheet bundle before the sheet bundle reaches the processing position, and then cause said conveying unit to stop conveying the sheet bundle so that the sheet bundle stops at the processing position.

2. The sheet processing apparatus as claimed in claim 1, wherein said pressing unit presses the fold top of the sheet bundle reversely to a conveyance direction of the sheet bundle.

3. The sheet processing apparatus as claimed in claim 1, further comprising:

a conveyance amount detecting unit configured to detect a conveyance amount of the sheet bundle conveyed by said conveying unit; and a leading end detecting unit configured to detect a leading end of the sheet bundle conveyed by said conveying unit, wherein said control unit controls, when said conveyance amount detecting unit detects that the sheet bundle has been conveyed by a predetermined distance after said leading end detecting unit has detected the leading end of the sheet bundle, said holding unit to start moving the at least one of the first holding member or the second holding member.

4. The sheet processing apparatus as claimed in claim 1, further comprising:

a thickness obtaining unit configured to obtain a thickness of the sheet bundle conveyed by said conveying unit, wherein said control unit controls said holding unit to start moving the at least one of the first holding member or the second holding member earlier when the thickness of the sheet bundle obtained by the thickness obtaining unit is a first thickness than when the thickness of the sheet bundle obtained by the thickness obtaining unit is a second thickness that is greater than the first thickness.

5. The sheet processing apparatus as claimed in claim 1, further comprising:

a number-of-sheets obtaining unit configured to obtain the number of sheets conveyed by said conveying unit, wherein said control unit controls said holding unit to start moving the at least one of the first holding member or the second holding member earlier when the number of sheets of the sheet bundle obtained by the number-of-sheets obtaining unit is a first number of sheets than when the number of sheets of the sheet bundle obtained by the number-of-sheets obtaining unit is a second number of sheets that is greater than the first number of sheets.

* * * * *